US009192895B2

(12) United States Patent
Meurer

(10) Patent No.: US 9,192,895 B2
(45) Date of Patent: Nov. 24, 2015

(54) CASCADE AERATOR ASSEMBLY

(71) Applicant: Meurer Research Inc., Golden, CO (US)

(72) Inventor: Charles Lonnie Meurer, Golden, CO (US)

( * ) Notice: Subject to any disclaimer, the term of this patent is extended or adjusted under 35 U.S.C. 154(b) by 145 days.

(21) Appl. No.: 13/851,744

(22) Filed: Mar. 27, 2013

(65) Prior Publication Data

US 2013/0256925 A1 Oct. 3, 2013

Related U.S. Application Data

(60) Provisional application No. 61/616,056, filed on Mar. 27, 2012.

(51) Int. Cl.
*B01F 3/04* (2006.01)

(52) U.S. Cl.
CPC ..... *B01F 3/04744* (2013.01)

(58) Field of Classification Search
CPC ..... B01F 3/04744
USPC ..... 261/114.1, 108, 119.1
See application file for complete search history.

(56) References Cited

U.S. PATENT DOCUMENTS

| | | | |
|---|---|---|---|
| 337,446 | A | 3/1886 | Scott et al. |
| 691,880 | A | 1/1902 | Snyder |
| 730,938 | A | 6/1903 | Luedke |
| 829,700 | A | 8/1906 | Drees |
| 1,869,344 | A | 7/1932 | Schonbein |
| 2,013,577 | A | 9/1935 | Pardee |
| 2,865,617 | A | 12/1958 | Dickens et al. |
| 2,884,236 | A | 4/1959 | Maille |
| 3,729,179 | A | 4/1973 | Keller |
| 4,132,761 | A | 1/1979 | Mix |
| 4,556,522 | A | 12/1985 | Wilson |
| 5,259,996 | A | 11/1993 | Morgan |

OTHER PUBLICATIONS

"Low Profile Cascade Aerators: The Most Efficient and Economical Method for Post Aeration" JMS—Jim Myers & Sons, Inc; dated Jun. 1, 2010.*

* cited by examiner

*Primary Examiner* — Robert A Hopkins
(74) *Attorney, Agent, or Firm* — Sheridan Ross P.C.

(57) ABSTRACT

An improved cascade aerator is disclosed, comprising a trough having a low profile slope, whereby the trough is divided into a plurality of adjacent longitudinal channels. In one embodiment, a plurality of low head baffles are mounted in spaced relationship and transversely of the longitudinal channels and are spaced apart from the floor of the trough.

20 Claims, 2 Drawing Sheets

CASCADE AERATOR ASSEMBLY

CROSS-REFERENCE TO RELATED APPLICATIONS

This application claims priority to U.S. Provisional Patent Application No. 61/616,056, filed Mar. 27, 2012, which is incorporated by reference herein in its entirety.

FIELD OF INVENTION

The present disclosure relates generally to an open channel-type aerator for use in connection with a liquid-containing basin, tank, or reservoir. More particularly, the disclosure relates to a low profile cascade aerator for the purpose of raising the dissolved oxygen (DO) concentration level of the basin effluent by incorporation of an improved cascade aerator assembly that comprises a plurality of transversely oriented baffles, which in a preferred embodiment are spaced apart from the floor or "trough" of the cascade aerator.

BACKGROUND OF THE INVENTION

Today, stringent water quality standards are imposed by Federal Regulations governing the effluent limits of treatment facilities. Current criteria specify a DO concentration between 3 and 6 mg/l, depending on the receiving stream requirements. Most existing wastewater treatment facilities cannot meet the newly implemented DO criteria. Consequently, post-aeration measures must be added for compliance with these criteria and regulations, and is often desirable for various water treatment systems regardless of the requirements of the system(s).

Several known post-aeration methods have been employed for oxygen transfer. In general, the most common methods involve various types of mechanical or conventional cascade aeration. Each of these methods has the disadvantage of being an expensive addition to existing wastewater treatment facilities. For example, mechanical aeration requires the addition of an aeration basin with adequate liquid retention capacity for oxygen infusion by electrically powered aeration equipment. This is a less desirable method of boosting oxygen levels in the liquid, but in the past was the only available solution. There are also two aggravating cost factors involved with mechanical aeration: the high initial investment for the basin and equipment, and the ongoing maintenance and operating expense.

In general, cascade post-aeration installations are more desirable and cost effective. There is no power consumption or maintenance expense, the primary requirement for the application of a cascade aerator being sufficient elevation to produce a waterfall. The normal requirement for oxygen transfer through prior art cascade aeration is twelve inches of water fall for each mg/l increase. For example, to raise the oxygen concentrations in water by 6 mg/l, a minimum fall of six feet is typically required. However, most existing facilities lack ample elevation change for the utilization of prior art cascade aerators and it would unnecessary expense to create the required elevation change is an established facility.

Therefore, a present need is felt to provide an improved cascade aerator assembly that comprises a plurality of transversely oriented baffles, which in a preferred embodiment are spaced apart from the floor or "trough" of the cascade aerator. Other benefits and advantages will become known upon reviewing the Summary and Detailed Description below, and upon review of the appended drawing figures. The benefits, embodiments, and/or characterizations described herein are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below.

SUMMARY OF THE INVENTION

A low profile fabricated cascade aerator in accordance with this disclosure eliminates or ameliorates the foregoing problems. Accordingly, the present invention is a simple, free flowing, efficient channel-type aeration device that can be installed in most existing treatment facilities at a reasonable cost.

The use of the word "cascade" is not intended to be limiting in this disclosure. The invention relates to a "cascade" only in the sense that it is water gravitating successively over stages of transversely oriented baffles. Contrary to the claimed benefits associated with prior art cascades where water is permitted to fall steeply from one step to the next creating splashing effects, the low profile cascade aerator of the present disclosure utilizes optimum slopes of 2 degrees to 8 degrees, with turbulence control aeration baffles incrementally spaced along the longitudinal axis of the low profile cascade aerator, optimizing the turbulent reactions of hydraulic jumps created by the baffles. The baffles create dams and segments along the channel, with increased velocity as the liquid flows over the baffles and falls to the next stage or segment. The increased velocity creates a shallow depth in the channel downstream of each baffle that crashes the liquid into the tail water of the deeper water formed by the successive baffle.

The turbulence control baffles are preferably fitted with air infusion plates. The plates are preferably but not always mounted vertically on top of the baffles to form air tubes from the atmospheric surface down to the crest of the baffles. Pressure differentials cause the air to run the crest and disperse in the form of fine bubbles into the liquid, enhancing oxygen transfer. Spacing is dependent upon flow rates and velocity of the liquid.

The impact of the high velocity water with the lower velocity water as it flows creates great turbulence, which in turn imports an effervescent effect on the liquid. Oxygen in the entrained air is absorbed by liquid through surface contact, and the greater the water-air surface contact, the greater the oxygen transfer. Additionally, pressure differential is created as water flows over the baffles, which in turn creates an undertow and backflow action, circulating the liquid within each segment of the channel and thereby exposing the liquid to the atmosphere with each pass absorbing more oxygen. This effect is enhanced by creating a space or slot between the baffles and the floor or "trough" of the channel. The small air bubbles and mixing created by the utilization of natural gravitational and fluid forces through controlled application of velocity, pressure differentials, baffles, slots, air infusion plates, baffle spacing, baffle height, channel depth, and optimum controlled head over the baffles (with minimum head loss throughout the unit) have been found to make this invention effective to provide approximately 6 mg/l with less than two feet fall in elevation.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the claims set forth herein below define the invention.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

In the drawings:

FIG. 1 is a perspective view of a cascade aerator according to one embodiment of the present disclosure; and FIG. 2 is a sectional view of a cascade aerator according to another embodiment of the present disclosure.

DETAILED DESCRIPTION OF THE INVENTION

Figure 1:
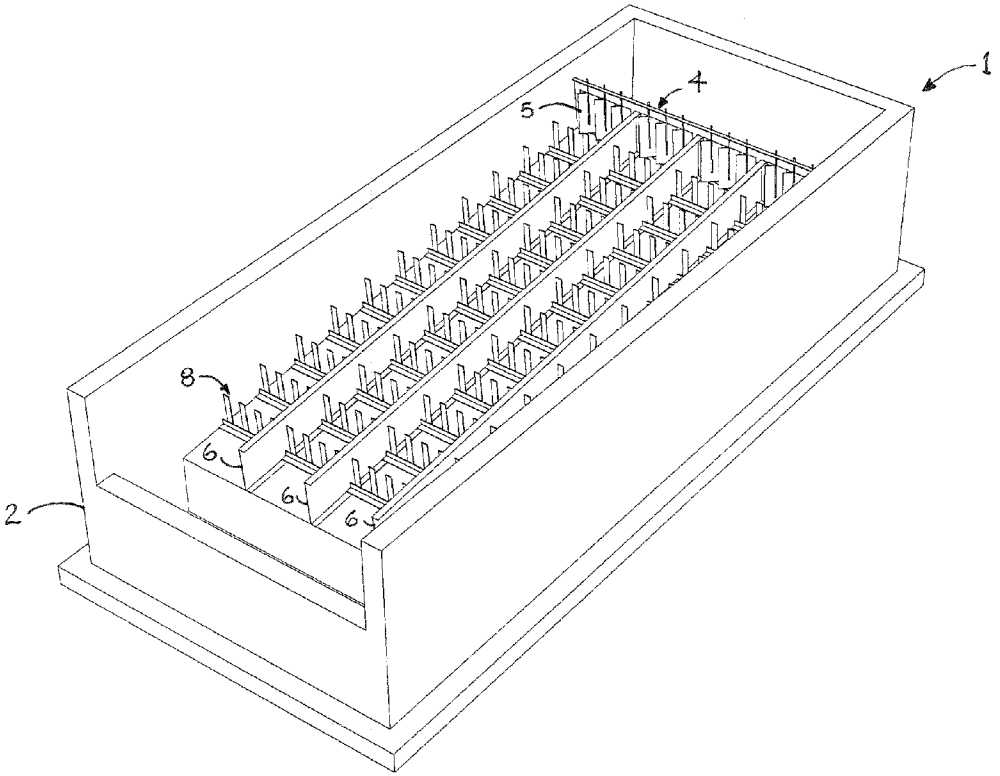

Referring in detail to the drawing figures, a low profile cascade aerator 1, 10 in accordance with the present invention is provided in a liquid-containing basin 2, 11 for increasing the dissolved oxygen level of the effluent liquid. The basin 2, 11 may comprise a tank, reservoir or pipe line which receives the final effluent from, by way of example but not limitation, a wastewater treatment facility.

According to varying embodiments described herein, the cascade aerator may be comprised of a basin 2, which may be formed from cast-in-place concrete, precast concrete or other material suitable to retain effluent received by the cascade aerator assembly. For example, one embodiment of the cascade aerator shown in FIG. 1 comprises a cast-in-place basin 2, which houses a number of dividers 6 and spaced apart baffles 8 in the open chamber formed by the basin 2. According to this embodiment, effluent enters the basin 2 on the elevated or upslope side of the baffle assembly, preferably through an input receptacle, where it may be further directed by a plurality of weirs 5 in a weir assembly 4 that may be adjustable according to the precise flow characteristics of the effluent, the desired flow control exiting the weirs 5, etc. In a preferred embodiment, the invention provides an improved cascade aerator assembly that comprises a plurality of transversely oriented baffles, which in a preferred embodiment are spaced apart from the floor or "trough" of the cascade aerator. The slot or gap may be from an insignificantly measurable amount to 1" between the baffle lower surface and the floor of the aerator assembly. In one embodiment the top surface of the baffles is bent or curved so as to form a lip or edge. The baffles may be any width for accommodating the width of the channel but are preferably less than 10 feet wide.

In one embodiment, the weir assembly 4 is controlled by hand. In an alternate embodiment, the weir assembly 4 may be controlled remotely and may be automated by means known and appreciated by those of ordinary skill in the art. As the effluent passes through the weirs 5 and into each of the longitudinal channels (formed by the dividers 6), the effluent passes around the baffles 8 and may pass underneath the baffles 8 (in an embodiment where the baffles 8 are mounted a distance above the bottom surface of each longitudinal channel). Thus, in one embodiment, the baffles 8 are supported on opposing lateral sides by either the dividers 6 and/or the adjacent walls of the basin 2.

In a preferred embodiment, the system in FIG. 1 provides substantially even distribution of fluid across all stages or channels 16 of the cascade aerator. In an alternate embodiment, the width of the cascade aerator tapers as the fluid moves down. This in turn prevents unwanted head loss, from top to bottom of the cascade aerator.

Figure 2:
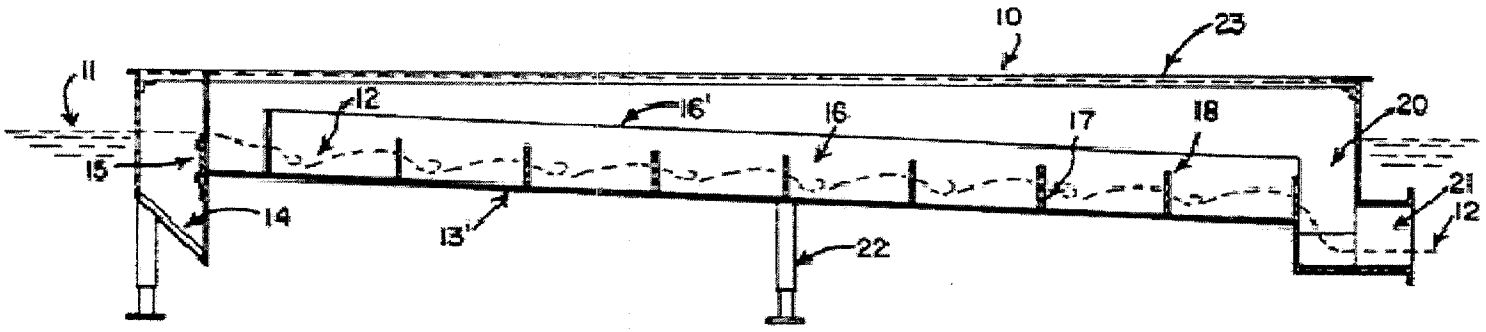

Referring in detail to FIG. 2, the aerator 10 preferably comprises a sluice or trough 13 having a sloping bottom wall 13' with a preferred gradient of between 2 degrees and 8 degrees. The trough 13 is preferably divided or compartmented into a plurality of longitudinal channels 16 by divider means 16' mounted on the bottom wall 13'. Inlet 14 of the aerator is preferably submerged below the liquid surface to inhibit floatable solids from passing through the aerator 10. All channels 16 slope downwardly and direct flow to a common receptacle 20. The receptacle 20 connects to an opening 21 that communicates with the exterior of the basin.

A weir 15 may be provided at the inlet 14 for flow monitoring and low water level control. The weir 15 can be adjusted horizontally for varying the basin liquid level. Each longitudinal channel 16 is thereby controlled at the inlet 14 with a flow control weir 19. Adjacent and additional flow control weirs are optional, and may be stepped or increased in height, preferably in increments of approximately one inch. In an alternate embodiment, inlet 14 may comprise a rotating gate or a pull-up gate to control flow into the cascade aerator channels 16.

As the flow through the first channel 26 reaches a preferred depth of 4 inches, the liquid rises above the flow control weir 19 of the next adjacent channel 16. The same progression is repeated through the third or more channels 16 as flow rates increase. The first channel 16 is designed for the minimum flow rate of the treatment facility being served.

According to one embodiment, the channels 16 are provided with a plurality of transverse low head aeration baffles 17 which function to create velocity and pressure changes throughout the length of the channels. Baffle 17 spacing is preferably 24" apart but may be between 12" and 36" apart without departing from the spirit of the disclosure. Air infusion plates 18, preferably 1¼" wide, are attached to the crest of the baffles 17 for injecting oxygen-laden air into the liquid. The plates 18 serve to form an air passage that communicates to the crest of the aeration baffle 17, whereby the air disperses along the length of the aeration baffle 17 crest.

The aerator 10 preferably is provided with adjustable legs 22. The legs 22 provide means for supporting, leveling and anchoring the aerator 10, and thereby provide adaptability as necessary for retrofitting to existing treatment facilities.

The top of the aerator 10 may be covered with an extruded grating 23. The grating 23 serves to provide protection for the aerator 10 from flying debris and animals and also serves as a service platform. The grating 23 may be oriented to deflect wind/air movement about the top of aerator 10 to further increase the DO concentration and further "froth" the fluid in the cascade aerator assembly.

The baffles may be made of any known metal or metal alloys. In an alternate embodiment the baffles are made of concrete. In another alternative embodiment, the baffles are made of a synthetic material, such as plastic, and may further be reinforced with fibers. According to another embodiment of the present disclosure, the baffles are mounted horizontally by placing each medial edge into a bracket-type channel placed on opposing sides of two facing longitudinal channels, and secured into place with a plurality of fixation devices such as locking nuts or bolts. In this manner, the spacing of the baffles from the floor of the channel may be selectively adjustable by a user, thereby permitting the user to choose the slot height for each baffle.

According to various embodiments, the baffles described herein may be fixed in position and orientation, but according to other embodiments may be adjustable with respect to orientation and location. For example, as shown in FIG. 1, there may be approximately four vertical baffles extending above a bracket for supporting the baffles in their upright position. In other embodiments, the number of baffles may be fewer or greater than four, and may be positioned closer together or farther apart then shown in FIG. 1. In addition, it is contemplated that in some embodiments the baffles may be staggered such that where a baffle appears in one longitudinal channel, that particular baffle may be absent in the adjacent longitudinal channel and vise versa.

In some embodiments, alternating baffles may be provided, with one particular baffle assembly being fixed while the downstream baffle assembly is adjustable. According to yet other embodiments of the present disclosure, the gap between the bracket assembly and the lower surface of the longitudinal channel may also be variable, such as by providing a adjustable bracket assembly on the joining sides of the bracket (i.e., the divider 6 and/or the adjacent walls of the basin). In this manner, increased oxidation of the effluent may be accomplished by creating greater distance between the bracket assembly and the bottom surface for certain baffle assemblies, while decreasing the gap between the bracket and the lower surface in other baffle assemblies. In yet other embodiments, there may be gap in certain baffle assemblies but not other baffles, for example by staggering with a baffle assembly spaced above the lower surface and the next adjacent downstream baffle assembly being spaced without a gap above the lower surface.

While various embodiment of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, inventive aspects lie in less than all features of a single foregoing disclosed embodiment.

While various embodiment of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims.

For further illustration, the information and materials supplied with the provisional and non-provisional patent applications from which this application claims priority are expressly made a part of this disclosure and incorporated by reference herein in their entirety.

Moreover, though the present disclosure has included description of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An aerator assembly, comprising:

a bottom wall having a first end and a second end, wherein the first end has a higher elevation than the second end, and the bottom wall is oriented on a gradient between the first end and the second end;

at least two substantially longitudinal side walls interconnected to the bottom wall, wherein at least one channel is formed on the bottom wall, wherein a first open end of the at least one channel is substantially coterminous with the first end of the bottom wall, and a second open end of the at least one channel is substantially coterminous with the second end of the bottom wall;

at least eight substantially lateral beams interconnected between the at least two substantially longitudinal side walls, wherein at least eight troughs are formed in each at least one channel; and at least four transversely oriented baffles selectively interconnected to each of the at least eight substantially lateral beams, and the at least four transversely oriented baffles are not interconnected to the bottom wall, wherein there is a fluid flow through the at least eight troughs from the first end of the bottom wall to the second end of the bottom wall.

2. The aerator assembly of claim 1, wherein the gradient between the first end and the second end of the bottom wall is between two degrees and eight degrees.

3. The aerator assembly of claim 1, wherein the first end of the bottom wall is larger in the lateral dimension than the second end of the bottom wall.

4. The aerator assembly of claim 1, wherein the at least four transversely oriented baffles are spaced no more than one inch above the bottom wall.

5. The aerator assembly of claim 1, wherein the at least four transversely oriented baffles are no more than ten feet wide.

6. The aerator assembly of claim 1, wherein the at least four transversely oriented baffles are spaced between twelve inches and thirty six inches apart.

7. The aerator assembly of claim 6, wherein the at least four transversely oriented baffles are spaced approximately twenty four inches apart.

8. The aerator assembly of claim 1, wherein the at least four transversely oriented baffles are selectively adjustable between a first position and a second position, said transversely oriented baffles devoid of any connection to the bottom wall.

9. The aerator assembly of claim 8, wherein the at least four transversely oriented baffles are in their closest arrangement to the bottom wall in the first position, and the at least four transversely oriented baffles are in their furthest arrangement to the bottom wall in the second position.

10. The aerator assembly of claim 8, wherein the at least four transversely oriented baffles are remotely adjusted between the first position and the second position.

11. The aerator assembly of claim 1, wherein an extruded grating covers the aerator assembly.

12. The aerator assembly of claim 1, further comprising:

at least one substantially lateral weir beam interconnected between the at least two substantially longitudinal side walls, wherein the at least one substantially lateral weir beam is located at the first end of the bottom wall, at least three transversely oriented axles rotatably interconnected to the at least one substantially lateral weir beam, and the at least one transversely oriented baffle is interconnected to each of the at least three transversely oriented axles, and the at least one transversely oriented baffle is not interconnected to the bottom wall, wherein the at least one transversely oriented baffle is rotatably adjustable between a first position and a second position.

13. The aerator assembly of claim 12, wherein the at least one transversely oriented baffle is oriented parallel with the fluid flow in the first position, and the at least one transversely oriented baffle is oriented perpendicular with the fluid flow in the second position.

14. The aerator assembly of claim 12, wherein at least one transversely oriented baffle is remotely adjusted between the first position and the second position.

15. An aerator assembly, comprising:

a bottom wall having a first end and a second end, wherein the first end has a higher elevation than the second end, and the bottom wall is oriented on a gradient between the first end and the second end;

at least two substantially longitudinal side walls interconnected to the bottom wall, wherein at least one channel is formed on the bottom wall, wherein a first open end of the at least one channel is substantially coterminous with the first end of the bottom wall, and a second open end of the at least one channel is substantially coterminous with the second end of the bottom wall;

at least eight substantially lateral beams interconnected between the at least two substantially longitudinal side walls, wherein at least eight troughs are formed in each at least one channel;

at least four transversely oriented baffles are selectively interconnected to each of the at least eight substantially lateral beams, and the at least four transversely oriented baffles are not interconnected to the bottom wall, wherein there is a fluid flow through the at least eight troughs from the first end of the bottom wall to the second end of the bottom wall; and the at least four transversely oriented baffles are mounted a distance above a bottom surface of at least one of said plurality of longitudinal channels to form a gap.

16. The aerator assembly of claim 15, wherein said gap about 1 inch.

17. The aerator assembly of claim 15, wherein in a top surface of the at least four transversely oriented baffles is bent or curved.

18. The aerator assembly of claim 15, further comprising a plurality of weirs in a weir assembly that are adjustable according to flow characteristics of an effluent.

19. The aerator assembly of claim 15, wherein a width of the aerator tapers to prevent a head loss from the top to the bottom of the aerator.

20. An aerator assembly, comprising:

a plurality of longitudinal channels configured to receive a fluid therethrough;

a plurality of dividers and baffles in fluid communication with at least one of said plurality of longitudinal channels having:

i) a bottom wall having a first end and a second end, wherein the first end has a higher elevation than the second end, and the bottom wall is oriented on a gradient between the first end and the second end; and ii) at least two substantially longitudinal side walls interconnected to the bottom wall, and at least eight substantially lateral beams interconnected between the at least two substantially longitudinal side walls, wherein at least eight troughs are formed in each at least one channel;

wherein said at least one of said plurality of longitudinal channels includes at least four transversely oriented baffles selectively interconnected to each of the at least eight substantially lateral beams, said baffles spaced between 12" and 36" apart, and the at least four transversely oriented baffles are not interconnected to the bottom wall and are mounted a distance above a bottom surface of at least one of said plurality of longitudinal channels, wherein there is a fluid flow through the at least eight troughs from the first end of the bottom wall to the second end of the bottom wall; wherein a pressure differential is created as water flows over the baffles, which in turn creates an undertow and backflow action, circulating liquid within said at least one of said plurality of longitudinal channels; and wherein a space is provided between the baffles and the bottom wall to permit liquid to pass underneath the baffles to generate fine bubbles into the liquid to enhance oxygen transfer.

* * * * *